US009280932B2

(12) United States Patent
Kim et al.

(10) Patent No.: US 9,280,932 B2
(45) Date of Patent: Mar. 8, 2016

(54) ORGANIC LIGHT EMITTING DISPLAY AND METHOD FOR DRIVING THE SAME

(71) Applicants: Jong-Soo Kim, Yongin (KR); Jee-Yoon Kang, Yongin (KR)

(72) Inventors: Jong-Soo Kim, Yongin (KR); Jee-Yoon Kang, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 348 days.

(21) Appl. No.: 13/901,475

(22) Filed: May 23, 2013

(65) Prior Publication Data

US 2014/0168189 A1 Jun. 19, 2014

(30) Foreign Application Priority Data

Dec. 14, 2012 (KR) ..... 10-2012-0146483

(51) Int. Cl.
*G09G 3/32* (2006.01)

(52) U.S. Cl.
CPC ..... *G09G 3/3233* (2013.01); *G09G 3/3291* (2013.01); *G09G 2300/0819* (2013.01); *G09G 2300/0861* (2013.01); *G09G 2320/045* (2013.01)

(58) Field of Classification Search
CPC ... G09G 3/3241; G09G 3/325; G09G 3/3258; G09G 2300/043; G09G 2320/0242; G09G 2320/0204; G09G 2320/04; G09G 2320/041; G09G 2320/043; G09G 2320/045; G09G 2320/046; G09G 2320/048
USPC ..... 345/212
See application file for complete search history.

(56) References Cited

U.S. PATENT DOCUMENTS

2007/0035487 A1* 2/2007 Ryu ..... G09G 3/3233 345/76
2009/0051628 A1* 2/2009 Kwon ..... G09G 3/3233 345/77
2011/0102403 A1* 5/2011 Kim ..... G09G 3/3233 345/211
2011/0227505 A1* 9/2011 Park ..... H05B 33/0896 315/297

FOREIGN PATENT DOCUMENTS

KR 10-2011-0104705 A 9/2011
KR 10-2012-0045252 A 5/2012

* cited by examiner

*Primary Examiner* — Aneeta Yodichkas
*Assistant Examiner* — Chineyere Wills-Burns
(74) *Attorney, Agent, or Firm* — Knobbe, Martens, Olson & Bear, LLP

(57) ABSTRACT

An organic light emitting diode (OLED) display and a method for driving the same, which can display an image with more uniform luminance is disclosed. In one aspect, the OLED display includes a plurality of pixels arranged in a matrix of a plurality of rows and a plurality of columns; a data driver supplying second data signals corresponding to a second data obtained by converting a first data, in response to first data signals corresponding to the first data or a data control signal; and a compensator converting output currents output from the pixels, corresponding to the first data signals into a output voltages, and supplying, to the data driver, the data control signal for converting the first data into the second data, corresponding to the output voltages and the first data based on the output voltages and the first data.

18 Claims, 3 Drawing Sheets

ORGANIC LIGHT EMITTING DISPLAY AND METHOD FOR DRIVING THE SAME

CROSS-REFERENCE TO RELATED APPLICATIONS

This application claims priority to and the benefit of Korean Patent Application No. 10-2012-0146483, filed on Dec. 14, 2012, in the Korean Intellectual Property Office, the entire content of which is incorporated herein by reference.

BACKGROUND

1. Field

The disclosed technology relates to an organic light emitting diode (OLED) display and a method for driving the same, and more particularly, to the same, which can display an image with more uniform luminance.

2. Description of the Related Technology

Various types of flat panel displays capable of reducing the weight and volume of cathode ray tubes have been developed. The flat panel display technologies include liquid crystal display, field emission display, plasma display panel, organic light emitting diode (OLED) display, and the like.

Among these, OLED displays use organic light emitting diodes (OLEDs) that emit light through recombination of electrons and holes. They exhibit a fast response speed and can be driven with reduced power consumption. In such displays, a driving transistor included in each pixel supplies, to an OLED, current having an amplitude corresponding to a data signal so that the OLED generates light.

In order to compensate for the differences in performance characteristics among pixels, displays may sense the entire characteristic of the pixels and store the sensed characteristic in a frame memory in its initial driving. Then, the display may compensate data signals to be supplied to the pixels based on information on the entire characteristic stored in the frame memory. Since such displays sense the entire pixel characteristic in its initial driving, a delay occurs, and a frame memory for storing the entire characteristic of pixels is required.

Further, such displays sense the pixel characteristic of the pixels using current. However, since the amplitude of current supplied to/from each pixel is small, the reliability of the compensation is low.

SUMMARY OF CERTAIN INVENTIVE ASPECTS

Embodiments provide an organic light emitting display and a method for driving the same, which can reduce a delay in its initial driving, simplify the structure of a circuit, and improve the reliability of compensation.

According to an aspect of the disclosed technology, an organic light emitting diode (OLED) display, comprises a plurality of pixels, wherein the pixels are arranged in a matrix of a plurality of rows and a plurality of columns; a data driver, responsive to first data signals corresponding to the first data or a data control signal, configured to supply second data signals corresponding to second data obtained by conversion of first data; and a compensator configured to convert output currents received from the pixels and corresponding to the first data signals into a output voltages, and, configured to supply to the data driver the data control signal for converting the first data into the second data based on the output voltages and the first data.

Various embodiments of this aspect are as follows. The data driver supplies the first data signals to pixels on one of the plurality of rows during a first period in a horizontal period, and supply, to the pixels on the one row the second data signals corresponding to the second data during a second period in the horizontal period.

Each output current is supplied from each pixel to the compensator through a driving transistor included in each of the pixels on the one row during the first period.

The organic light emitting display further comprises a scan driver progressively supplying a scan signal to the pixels through scan lines, and progressively supplying an emission control signal to the pixels through emission control lines.

The scan driver supplies the scan signal during the one horizontal period, and supply the emission control signal after the horizontal period.

Each pixel includes an organic light emitting diode (OLED); and a pixel circuit supplying, to the compensator, current having an amplitude corresponding to that of any one of the first data signals as any one of the output currents during the first period, and supplying to the OLED, current having an amplitude corresponding to that of any one of the second data signals after the horizontal period.

The pixel circuit includes a storage capacitor coupled between a first power source and a first node; a first transistor charging, via the storage capacitor, a voltage having an amplitude corresponding to that of any one of the first data signals or any one of the second data signals, in response to the scan signal; a second transistor coupled between the first power source and a second node, and allowing a first current having an amplitude corresponding to that of the voltage charged in the storage capacitor to pass from the first power source through the second node; a mirror circuit coupled among the first power source, the second node, an anode electrode of the organic light emitting diode and a feedback line, and supplying the first current to the feedback line and supplying, to the OLED, a second current having an amplitude in proportion to that of the first current; and a third transistor controlling the coupling between the mirror circuit and the anode electrode of the organic light emitting diode, in response to the emission control signal.

The amplitudes of the first and second currents are identical to each other.

The mirror circuit includes a fourth transistor coupled between the second node and the feedback line, and having a gate electrode coupled between a third node and the feedback line; and a fifth transistor coupled between the first power source and the third transistor, and having a gate electrode coupled to the third node.

The compensator includes a sensing unit converting the output currents into the output voltages, and converting the output voltages into digital signals; and a controller outputting the data control signal for converting the first data into the second data, based on the digital signals and the first data.

The sensing unit includes a current-voltage converter converting the output currents into first voltages; and an analog-digital converter converting the first voltages into the digital signals.

The controller reads, from a look-up table, the second data corresponding to a combination of the digital signal and the first data, and supply the read second data as the data control signal to the data driver.

The compensator includes a sensing unit converting the output currents into the output voltages, comparing the output voltages with the first data signals, and generating digital signals according to the compared result; and a controller outputting the data control signal for converting the first data into the second data, based on the digital signals and the first data.

The sensing unit includes a current-voltage converter configured to convert the output currents into first voltages; a comparator configured to compare the first voltages with the first data signals, and outputting differences between the first voltages and the first data signals as second voltages; and an analog-digital converter configured to convert the second voltages into the digital signals.

The controller may read, from a look-up table the second data corresponding to a combination of the digital signal and the first data and supply the read second data as the data control signal to the data driver.

According to an aspect of the disclosed technology, a method for driving an organic light emitting diode (OLED) display, comprises supplying, to pixels on one row, first data signals corresponding to first data, during a first period in a horizontal period; converting, into first voltages, output currents of driving transistors included in the pixels on the one row, generated in response to the first data signals; converting the first data into second data based on the first voltages; and supplying, to the pixels on the one row, second data signals corresponding to the second data during a second period in the horizontal period.

Various embodiments of this aspect are as follows. The converting comprises converting the first voltages into digital values; and reading, from a look-up table, the second data corresponding to a combination of the digital values and the first data.

The converting comprises generating second voltages corresponding to differences between the first voltages and the first data signals; converting the second voltages into digital values; and reading, from the look-up table, the second data corresponding to the combination of the digital values and the first data.

In the organic light emitting display and the method for driving the same according to the disclosed technology, during one horizontal period, the organic light emitting display converts output currents of driving transistors included in pixels on one row into voltages and then senses the converted voltages, and compensates for data signals to be supplied to the pixels on the one row, based on the sensed output voltages, so that it is possible to reduce a delay in its initial driving and to simplify a circuit structure.

Further, the organic light emitting display converts the output currents of the driving transistors into the output voltages and then senses the converted output voltages, so that it is possible to improve the reliability of compensation.

BRIEF DESCRIPTION OF THE DRAWINGS

The accompanying drawings, together with the specification, illustrate exemplary embodiments of the disclosed technology, and, together with the description, serve to explain the principles of the disclosed technology.

DETAILED DESCRIPTION OF CERTAIN INVENTIVE EMBODIMENTS

Figure 1:
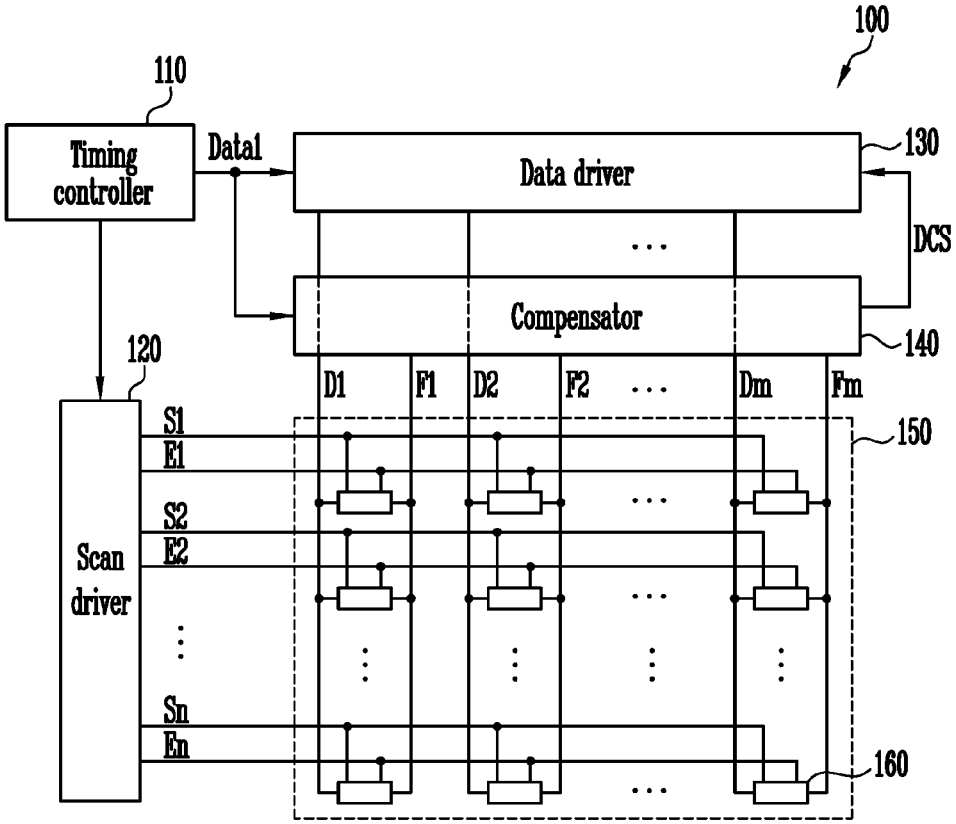
FIG. 1 is a block diagram illustrating an organic light emitting display according to an embodiment of the disclosed technology.

Hereinafter, certain exemplary embodiments according to the disclosed technology will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a block diagram illustrating an organic light emitting display according to an embodiment of the disclosed technology.

Referring to FIG. 1, the organic light emitting display 100 according to this embodiment includes a timing controller 110, a scan driver 120, a data driver 130, a compensator 140 and a pixel unit 150.

The timing controller 110 controls operations of the scan driver 120 and the data driver 130. The timing controller 110 rearranges externally supplied data Data1 and outputs the rearranged data to the data driver 130.

Specifically, the timing controller 110 generates a scan driving control signal, in response to an externally supplied synchronization signal (not shown) and the generated scan driving control signal to the scan driver 120. The timing controller 110 generates a data driving control signal that is supplied to the data driver 130.

The scan driver 120 progressively supplies a scan signal to scan lines S1 to Sn, in response to the scan driving control signal output from the timing controller 110. Furthermore, the scan driver 120 progressively supplies an emission control signal to emission control lines E1 to En.

The scan signal is supplied during one horizontal period (HP of FIG. 5), and the emission control signal is supplied during a period other than the one horizontal period HP. For example, the scan signal and the emission control signal may be signals that are level complementary to each other.

The data driver 130 supplies first data signals (DS1 of FIG. 5) or second data signals (DS2 of FIG. 5) to the pixel unit 150 through data lines D1 to Dm, under the control of the timing controller 110, i.e., in response to the data driving control signal output from the timing controller 110.

Specifically, the data driver 130 supplies the first data signals DS1 corresponding to the first data Data1 during a first period P1. The data driver 130 converts the first data Data1 into second data Data2, in response to the data control signal DCS output from the compensator 140, and supplies the second data signals DS2 corresponding to the second data Data2 to the pixel unit 150 during a second period P2. Here, the data control signal DCS may be the second data Data2 or the difference between the first data Data1 and the second data Data2.

The compensator 140 receives output currents of driving transistors included in pixels 160 on one row from the pixel unit 150 through feedback lines F1 to Fm during the first period P1. Each output current is supplied from a first power source (ELVDD of FIG. 4) to the compensator 140 through the driving transistor included in each of the pixels 160 on the one row, e.g., a second transistor (M2 of FIG. 4) during the first period P1.

The compensator 140 converts the output currents into output voltages, respectively. The compensator 140 supplies the data control signal DCS for converting the first data Data1 into the second data Data2, based on the output voltages and the first data Data1.

The function and operation of the compensator 140 will be described in detail with reference to FIGS. 2 and 3.

The pixel unit 150 includes a plurality of pixels 160 arranged in a matrix of a plurality of rows and a plurality of columns. The pixels 160 are arranged at intersection portions of the data lines D1 to Dm, the feedback lines F1 to Fm, the scan lines S1 to Sn and the emission control lines E1 to En.

Figure 4:
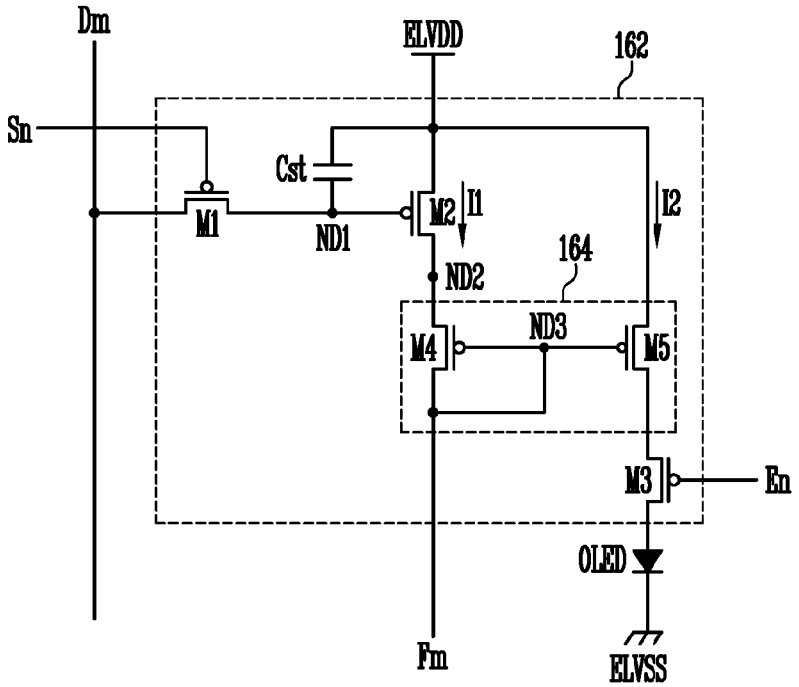
FIG. 4 is a circuit diagram illustrating an embodiment of a pixel shown in FIG. 1.
Figure 5:
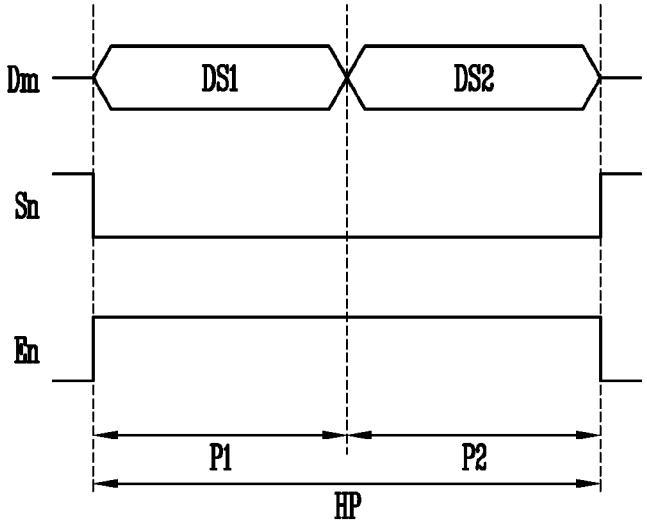
FIG. 5 is a waveform diagram illustrating a method for driving an organic light emitting display according to an embodiment of the disclosed technology.

With reference to FIGS. 4 and 5, during the first period P1 (FIG. 5), each pixel 160 supplies the output current of the driving transistor, generated by any one of the first data signals DS1 supplied from the data driver 130, in response to the scan signal supplied from the scan driver 120.

During the second period P2 (FIG. 5), each pixel 160 charges, in a storage capacitor (Cst of FIG. 4) included in each pixel 160, a voltage having an amplitude corresponding to any one of the second data signals DS2 supplied from the data driver 130, in response to the scan signal supplied from the scan driver 120.

After the one horizontal period HP (FIG. 5), each pixel 160 supplies, to an organic light emitting diode (OLED of FIG. 4), current having an amplitude corresponding to that of the voltage charged in the storage capacitor Cst, in response to the emission control signal supplied from the scan driver 120.

Figure 2:
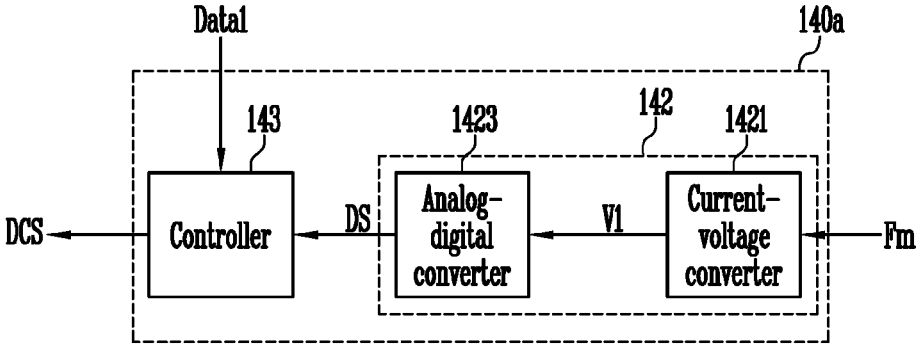
FIG. 2 is a block diagram illustrating an embodiment of a compensator shown in FIG. 1.

FIG. 2 is a block diagram illustrating an embodiment of the compensator shown in FIG. 1. For convenience of illustration, only one feedback line Fm is shown in FIG. 2, but embodiments of the disclosed technology are not limited thereto.

Referring to FIG. 2, the compensator 140*a* according to this embodiment includes a sensing unit 142 and a controller 143.

The sensing unit 142 converts the output current of the driving transistor included in the pixel 160, supplied through the feedback line Fm, into an output voltage, e.g., a first voltage V1, and converts the first voltage V1 into a digital signal DS. The sensing unit 142 includes a current-voltage converter 1421 and an analog-digital converter 1423.

The current-voltage converter 1421 converts the output current of the driving transistor included in the pixel 160, supplied through the feedback line Fm, into the first voltage V1. The current-voltage converter 1421 may be implemented as an amplifier. The current-voltage converter 1421 may amplify the output currents and convert the amplified output currents into the first voltages V1, respectively.

The analog-digital converter 1423 converts the first voltage V1 output from the current-voltage converter 1421 into a digital signal DS, and outputs the converted digital signal to the controller 143.

The controller 143 outputs, to the data driver 130, the data control signal DCS for converting the first data Data1 into the second data Data2, based on the digital signal DS output from the sensing unit 142 and the first data Data1.

According to an embodiment, the controller 143 may read second data Data2 corresponding to a combination of the digital signal DS and the first data Data1 from a look-up-table, and output the read second data Data2 as the data control signal DCS to the data driver 130. That is, the look-up table (stored in a digital memory device) may store the second data Data2 corresponding to the combination of the digital signal DS and the first data Data1.

For example, it is assumed that the first data Data1 is '10000000' indicating a gray scale value '128,' and an ideal digital signal DS corresponding to the first data Data1 is '0001.' In addition, it is assumed that the digital signal DS substantially output from the sensing unit 142 by applying the first data Data1 to the pixel 160 is '0010.' In this case, the controller 143 reads the second data Data2 to be '0001' from the look-up-table. That is, the controller 143 reads data corresponding to the combination of the first data Data1 '10000000' and the digital signal DS '0010', e.g., '01111000' indicating a gray scale value '120' from the look-up-table.

During the second period P2, the data driver 130 supplies, to the pixel 160, the second data signal DS2 corresponding to the second data Data2 '01111000' indicating the gray scale value '120,' and accordingly, the pixel 160 emits light with the desired luminance.

According to another embodiment, the controller 143 may read a difference between the first data Data1 and the second data Data2, corresponding to the combination of the digital signal DS and the first data Data1, from the look-up table, and output the read difference as the data control signal DCS to the data driver 130. That is, the look-up table may store the difference between the first data Data1 and the second data Data2, corresponding to the combination of the digital signal DS and the first data Data1.

In the embodiment described above, the controller 143 may read data corresponding to a combination of the first data Data1 '10000000' and the digital signal DS '0010,' e.g., '0111' as the difference between the first data Data1 and the second data Data2, and output the read difference as the data control signal DCS to the data driver 130.

Figure 3:
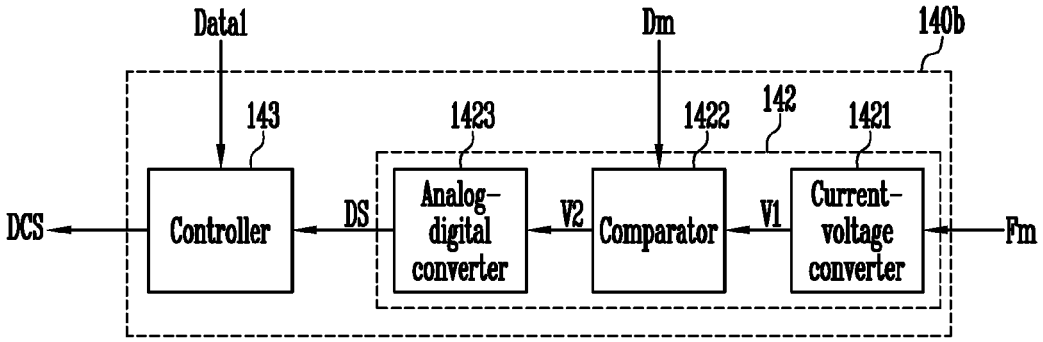
FIG. 3 is a block diagram illustrating another embodiment of the compensator shown in FIG. 1.

FIG. 3 is a block diagram illustrating another embodiment of the compensator shown in FIG. 1. The function and operation of the compensator 140*b* shown in FIG. 3 are substantially identical to those of the compensator 140*a* shown in FIG. 2, except that the compensator 140*b* includes a comparator 1422, and therefore, their detailed description will be omitted.

Referring to FIG. 3, the compensator 140*b* according to this embodiment includes a sensing unit 142 and a controller 143. The sensing unit 142 includes a current-voltage converter 1421, a comparator 1422 and an analog-digital converter 1423.

The comparator 1422 compares the amplitude of any one of the first data signals DS1 supplied through the data line Dm with that of the first voltage V1 output from the current-voltage converter 1421. According to the compared result, the comparator 1422 supplies, to the analog-digital converter 1423, the difference between the amplitudes of the first voltage V1 and any one of the first data signals DS1 as a second voltage V2. In this configuration, the comparator 1422 may be implemented with a plurality of differential amplifiers.

In such embodiments, the analog-digital converter 1423 converts the second voltage V2 supplied from the comparator 1422 into a digital signal DS, and supplies the converted digital signal to the controller 143.

FIG. 4 is a circuit diagram illustrating an embodiment of the pixel shown in FIG. 1. The representative structure of the pixel 160 is shown in FIG. 4, but embodiments of the disclosed technology are not limited thereto. A circuit configuration where transistors M1 to M5 are implemented as p-type transistors is shown in FIG. 4, but embodiments of the disclosed technology are not limited thereto. For example, the transistors M1 to M5 may be implemented as n-type transistors. In configurations where the transistors M1 to M5 are implemented as the n-type transistors, the polarity in the waveform diagram shown in FIG. 5 is reversed. In configurations where the transistors M4 and M5 are implemented as the n-type transistors, a gate electrode of each of the transistors M4 and M5 is not coupled to the feedback line Fm but may be coupled to a second node ND2.

Referring to FIG. 4, the pixel 160 includes an organic light emitting diode OLED and a pixel circuit 162.

The organic light emitting diode OLED is coupled between the pixel circuit 162 and the second power source ELVSS, and generates light with luminance corresponding to the amplitude of current supplied from the pixel circuit 162. The second power source ELVSS is set to a voltage lower than that of the first power source ELVDD, e.g., a ground voltage.

The pixel circuit 162 is coupled among a data line Dm, a feedback line Fm, a scan line Sn, an emission control line En, the first power source ELVDD and an anode electrode of the organic light emitting diode OLED.

During the first period P1 in the one horizontal period HP (FIG. 5), the pixel circuit 162 supplies output currents of a driving transistor, e.g., a second transistor M2, from the first power source ELVDD through the feedback line Fm, in response to a first data signal DS1 supplied through the data line Dm.

During the second period P2 in the one horizontal period HP (FIG. 5), the pixel circuit 162 charges, in a storage capacitor Cst, a voltage having an amplitude corresponding to that of a second data signal DS2 supplied through the data line Dm.

After the one horizontal period HP, the pixel circuit 162 controls current flowing from the first power source ELVDD to the second power source ELVSS via the organic light emitting diode OLED.

The pixel circuit 162 includes the storage capacitor Cst, a first transistor M1, the second transistor M2, a third transistor M3 and a mirror circuit 164.

The storage capacitor Cst is coupled between the first power source ELVDD and a first node ND1, and the first transistor M1 is coupled between the data line Dm and the first node ND1. The second transistor M2 is coupled between the first power source ELVDD and a second node ND2, and the third transistor M3 is coupled between the mirror circuit 164 and the anode electrode of the OLED. The mirror circuit 164 is coupled among the second node ND2, the third transistor M3, the first power source ELVDD and the feedback line Fm.

A first electrode of the first transistor M1 is coupled to the data line Dm, and a second electrode of the first transistor M1 is coupled to the first node ND1. A gate electrode of the first transistor M1 is coupled to the scan line Sn. The first transistor M1 supplies, to the first node ND1, a first or second data signal supplied through the data line Dm, in response to a scan signal supplied to the scan line Sn. That is, the first transistor M1 charges, in the storage capacitor Cst, a voltage having an amplitude corresponding to that of the first or second data signal, in response to the scan signal.

Here, the first electrode is set as any one of drain and source electrodes, and the second electrode is set as an electrode different from the first electrode. For example, if the first electrode is set as the source electrode, the second electrode is set as the drain electrode.

A first electrode of the second transistor M2 is coupled to the first power source ELVDD, and a second electrode of the second transistor M2 is coupled to the second node ND2. A gate electrode of the second transistor M2 is coupled to the first node ND1. The second transistor M2 allows a first current I1 having an amplitude corresponding to that of the voltage charged in the storage capacitor Cst to be flowed from the first power source ELVDD through the second node ND2. Specifically, the second transistor M2 allows the first current I1 having an amplitude corresponding to that of the first data signal DS1 to be flowed during the first period P1 in the one horizontal period HP, and allows the first current I1 having an amplitude corresponding to that of the second data signal DS2 to be flowed during the other period except the first period P1.

A first electrode of the third transistor M3 is coupled to the mirror circuit 164, i.e., a fifth transistor M5 of the mirror circuit 164, and a second electrode of the third transistor M3 is coupled to the anode electrode of the OLED. A gate electrode of the third transistor M3 is coupled to the emission control line En. The third transistor M3 controls the coupling between the mirror circuit 164 and the anode electrode of the OLED, in response to an emission control signal supplied through the emission control line En. The third transistor M3 supplies, to the OLED, a second current I2 having an amplitude in proportion to that of the first current I1 during the other period except the one horizontal period HP, i.e., the period in which the emission control signal is supplied.

The mirror circuit 164 supplies to the compensator 140 the first current I1 supplied from the second transistor M2, through the feedback line Fm. The mirror circuit 164 supplies to the OLED the second current I2 having the amplitude in proportion to that of the first current I1, through the third transistor M3.

The mirror circuit 164 includes a fourth transistor M4 and the fifth transistor M5. A first electrode of the fourth transistor M4 is coupled to the second node ND2, and a second electrode of the fourth transistor M4 is coupled to the feedback line Fm. A gate electrode of the fourth transistor M4 is coupled to a third node ND3. A first electrode of the fifth transistor M5 is coupled to the first power source ELVDD, and a second electrode of the fifth transistor M5 is coupled to the third transistor M3. A gate electrode of the fifth transistor M5 is coupled to the third node ND3. In this case, the feedback line Fm and the third node ND3 are coupled to each other. According to an embodiment, in a case where the fourth and fifth transistors M4 and M5 are implemented as n-type transistors, the second and third nodes ND2 and ND3 may be coupled to each other.

The amplitude of the second current I2 is represented as shown below in Equation 1.

$$I2 = \frac{W6/L5}{W4/L4} I1 \qquad \text{Equation 1}$$

Here, 'W4' denotes a width of the fourth transistor M4, and L4' denotes a length of the fourth transistor M4. 'W5' denotes a width of the fifth transistor M5, and L5' denotes a length of the fifth transistor M5.

According to an embodiment, the amplitudes of the first and second currents I1 and I2 may be set to be identical to each other by controlling the ratio of the width W4 of the fourth transistor M4, the length L4 of the fourth transistor M4, the width W5 of the fifth transistor M5 and the length L5 of the fifth transistor M5.

FIG. 5 is a waveform diagram illustrating a method for driving an OLED display according to embodiments of the disclosed technology.

Referring to FIG. 5, the scan signal supplied through the scan line Sn is supplied during the one horizontal period HP, and the emission control signal supplied through the emission control line En is supplied during the other period except the one horizontal period HP.

Since the emission control signal is not supplied during the one horizontal period HP, the pixel 160 does not emit light and it charges a voltage having an amplitude corresponding to that of the first or second data signal DS1 or DS2 supplied through the data line Dm in the storage capacitor Cst included in the pixel 160.

Specifically, during the first period P1 in the one horizontal period HP, the pixel 160 charges, in the storage capacitor Cst, a voltage having an amplitude corresponding to that of the first data signal DS1 supplied through the data line Dm, in response to the scan signal, and supplies output current of the driving transistor, e.g., the second transistor M2 to the feedback line Fm.

In this case, the compensator 140 converts the output current supplied through the feedback line Fm into an output voltage, and converts a first data Data1 into a second data Data2, based on the amplitude of the converted output voltage.

During the second period P2 in the one horizontal period HP, the data driver 130 supplies, to the pixel 160, a second data signal DS2 corresponding to the second data Data2, through the data line Dm. In this case, the pixel 160 charges, via the storage capacitor Cst, a voltage having an amplitude corresponding to that of the second data signal DS2, in response to the scan signal.

After the one horizontal period HP, the pixel 160 generates light with luminance corresponding to the amplitude of the voltage charged in the storage capacitor Cst, i.e., the second data signal DS2, in response to the emission control signal supplied through the emission control line En.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting diode (OLED) display, comprising:

a plurality of pixels, wherein the pixels are arranged in a matrix of a plurality of rows and a plurality of columns and each pixel includes an organic light emitting diode (OLED);

a data driver, responsive to first data signals corresponding to the first data or a data control signal, configured to supply second data signals corresponding to second data obtained by conversion of first data; and a compensator configured to convert output currents received from the pixels and corresponding to the first data signals into a output voltages, and configured to supply to the data driver the data control signal for converting the first data into the second data based on the output voltages and the first data, the compensator further configured to receive a current having an amplitude corresponding to that of any one of the first data signals as any one of the output currents during a first period in horizontal period, and supplying to the OLED a current having an amplitude corresponding to that of any one of the second data signals after the horizontal period.

2. The OLED display of claim 1, wherein the data driver supplies the first data signals to pixels on one of the plurality of rows during a first period in a horizontal period, and supplies to the pixels on the one row the second data signals corresponding to the second data during a second period in the horizontal period.

3. The OLED display of claim 2, wherein each output current is supplied from each pixel to the compensator through a driving transistor included in each of the pixels on the one row during the first period.

4. The OLED display of claim 3, further comprising a scan driver progressively supplying a scan signal to the pixels through scan lines, and progressively supplying an emission control signal to the pixels through emission control lines.

5. The OLED display of claim 4, wherein the scan driver supplies the scan signal during the horizontal period, and supplies the emission control signal after the horizontal period.

6. The OLED display of claim 3, wherein the compensator includes:

a sensing unit converting the output currents into the output voltages, and converting the output voltages into digital signals; and a controller outputting the data control signal for converting the first data into the second data based on the digital signals and the first data.

7. The OLED display of claim 6, wherein the sensing unit includes:

a current-voltage converter converting the output currents into first voltages; and an analog-digital converter converting the first voltages into the digital signals.

8. The OLED display of claim 6, wherein the controller reads, from a look-up table, the second data corresponding to a combination of the digital signal and the first data, and supplies the read second data as the data control signal to the data driver.

9. An organic light emitting diode (OLED) display, comprising:

a plurality of pixels, wherein the pixels are arranged in a matrix of a plurality of rows and a plurality of columns;

a data driver, responsive to first data signals corresponding to the first data or a data control signal, configured to supply second data signals corresponding to second data obtained by conversion of first data, wherein the data driver supplies the first data signals to pixels on one of the plurality of rows during a first period in a horizontal period, and supplies to the pixels on the one row the second data signals corresponding to the second data during a second period in the horizontal period;

a compensator configured to convert output currents received from the pixels and corresponding to the first data signals into a output voltages, and configured to supply to the data driver the data control signal for converting the first data into the second data based on the output voltages and the first data, wherein each output current is supplied from each pixel to the compensator through a driving transistor included in each of the pixels on the one row during the first period; and a scan driver progressively supplying a scan signal to the pixels through scan lines, and progressively supplying an emission control signal to the pixels through emission control lines, wherein the scan driver supplies the scan signal during the horizontal period, and supplies the emission control signal after the horizontal period wherein each pixel includes:

an organic light emitting diode (OLED); and a pixel circuit supplying, to the compensator, current having an amplitude corresponding to that of any one of the first data signals as any one of the output currents during the first period, and supplying to the OLED current having an amplitude corresponding to that of any one of the second data signals after the horizontal period.

10. The OLED display of claim 9, wherein the pixel circuit includes:

a storage capacitor coupled between a first power source and a first node;

a first transistor charging, via the storage capacitor, a voltage having an amplitude corresponding to that of any one of the first data signals or any one of the second data signals, in response to the scan signal;

a second transistor coupled between the first power source and a second node, and allowing a first current having an amplitude corresponding to that of the voltage charged in the storage capacitor to pass from the first power source through the second node;

a mirror circuit coupled among the first power source, the second node, an anode electrode of the organic light emitting diode and a feedback line, and supplying the first current to the feedback line and supplying, to the OLED, a second current having an amplitude in proportion to that of the first current; and a third transistor controlling the coupling between the mirror circuit and the anode electrode of the organic light emitting diode, in response to the emission control signal.

11. The OLED display of claim 10, wherein the amplitudes of the first and second currents are identical to each other.

12. The OLED display of claim 10, wherein the mirror circuit includes:

a fourth transistor coupled between the second node and the feedback line, and having a gate electrode coupled between a third node and the feedback line; and a fifth transistor coupled between the first power source and the third transistor, and having a gate electrode coupled to the third node.

13. An organic light emitting diode (OLED) display, comprising:

a plurality of pixels, wherein the pixels are arranged in a matrix of a plurality of rows and a plurality of columns;

a data driver, responsive to first data signals corresponding to the first data or a data control signal, configured to supply second data signals corresponding to second data obtained by conversion of first data, wherein the data driver supplies the first data signals to pixels on one of the plurality of rows during a first period in a horizontal period, and supplies to the pixels on the one row the second data signals corresponding to the second data during a second period in the horizontal period; and a compensator configured to convert output currents received from the pixels and corresponding to the first data signals into a output voltages, and configured to supply to the data driver the data control signal for converting the first data into the second data based on the output voltages and the first data, wherein each output current is supplied from each pixel to the compensator through a driving transistor included in each of the pixels on the one row during the first period, and wherein the compensator includes:

a sensing unit converting the output currents into the output voltages, comparing the output voltages with the first data signals, and generating digital signals according to the compared result; and a controller outputting the data control signal for converting the first data into the second data based on the digital signals and the first data.

14. The OLED display of claim 13, wherein the sensing unit includes:

a current-voltage converter configured to convert the output currents into first voltages;

a comparator configured to compare the first voltages with the first data signals, and outputting differences between the first voltages and the first data signals as second voltages; and an analog-digital converter configured to convert the second voltages into the digital signals.

15. The OLED display of claim 13, wherein the controller reads from a look-up table the second data corresponding to a combination of the digital signal and the first data and supplies the read second data as the data control signal to the data driver.

16. A method for driving an organic light emitting diode (OLED) display, comprising:

supplying, to pixels on one row, first data signals corresponding to first data, during a first period in a horizontal period;

converting, into first voltages, output currents of driving transistors included in the pixels on the one row, generated in response to the first data signals;

converting the first data into second data based on the first voltages;

supplying, to the pixels on the one row, second data signals corresponding to the second data during a second period in the horizontal period; and supplying, to OLEDs included in the pixels, a current corresponding to the second data signals after the horizontal period.

17. The method of claim 16, wherein the converting comprises:

converting the first voltages into digital values; and reading, from a look-up table, the second data corresponding to a combination of the digital values and the first data.

18. A method for driving an organic light emitting diode (OLED) display, comprising:

supplying, to pixels on one row, first data signals corresponding to first data, during a first period in a horizontal period;

converting, into first voltages, output currents of driving transistors included in the pixels on the one row, generated in response to the first data signals;

converting the first data into second data based on the first voltages, wherein the converting comprises:

generating second voltages corresponding to differences between the first voltages and the first data signals;

converting the second voltages into digital values; and reading, from the look-up table, the second data corresponding to the combination of the digital values and the first data; and supplying, to the pixels on the one row, second data signals corresponding to the second data during a second period in the horizontal period.

* * * * *